US008613417B2

(12) United States Patent
Kraus, Jr.

(10) Patent No.: US 8,613,417 B2
(45) Date of Patent: Dec. 24, 2013

(54) COASTER AND DRINK COVER

(76) Inventor: Donald William Kraus, Jr., Timonium, MD (US)

( * ) Notice: Subject to any disclaimer, the term of this patent is extended or adjusted under 35 U.S.C. 154(b) by 244 days.

(21) Appl. No.: 12/800,930

(22) Filed: May 26, 2010

(65) Prior Publication Data

US 2011/0290976 A1 Dec. 1, 2011

(51) Int. Cl.
*A47G 29/00* (2006.01)

(52) U.S. Cl.
USPC ..... 248/346.11; 428/40.1

(58) Field of Classification Search
USPC ..... 248/346.11, 683, 205.3; 428/40.1, 131, 428/68
See application file for complete search history.

(56) References Cited

U.S. PATENT DOCUMENTS 2,680,931 A * 6/1954 Champion ..... 248/346.11
5,018,695 A * 5/1991 Bishop ..... 248/346.11
5,024,014 A * 6/1991 Swierczek ..... 40/310
5,413,302 A * 5/1995 Ferster ..... 248/346.11
5,938,162 A * 8/1999 Honjo ..... 248/346.11
6,475,585 B1 * 11/2002 Yamanashi et al. ..... 428/40.1
6,619,608 B1 * 9/2003 Mulvey et al. ..... 248/346.11
7,721,408 B2 * 5/2010 Solazzi ..... 29/521
2006/0151413 A1 7/2006 Ingram
2007/0178284 A1 8/2007 Barry
2008/0072412 A1 3/2008 Solazzi
2008/0302794 A1 12/2008 Wagner et al.
2009/0020546 A1 1/2009 Kiehne
2009/0047469 A1 * 2/2009 Lane et al. ..... 428/131

* cited by examiner

*Primary Examiner* — Tan Le
(74) *Attorney, Agent, or Firm* — William S. Ramsey

(57) ABSTRACT

Embodiments include combination coaster drink covers which serve as an ordinary bar coaster and absorb moisture from the outside of a drink glass, protect the bar surface from moisture, and furthermore serve to cover and adhere to the top of the drink glass, thereby indicating the intention of the drink owner to resume possession and preventing adulteration of or tampering with the drink during the owner's temporary absence. Embodiments include an upper coaster layer, adhesive layer, release layer, and lower coaster layer. Other embodiments include an upper coaster layer, adhesive layer and release layer.

11 Claims, 4 Drawing Sheets

COASTER AND DRINK COVER

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

Embodiments relate to combination coasters and devices for use in a public drinking establishment for indicating that a drink has not been abandoned and for preventing the introduction of foreign substances into the drink.

2. Description of Related Art Including Information Disclosed Under 37 CFR 1.97 and 1.98.

Embodiments of the present disclosure are directed to meeting two recently recognized needs. The introduction of smoking restrictions in public places such as clubs, bars, and taverns including private clubs has created the need for a simple means of indicating that a drink owner has temporarily absented himself or herself from the establishment in order to smoke, or for other purposes, and intends to return. By indicating an intention to return, the combination coaster and drink cover of the present disclosure serves to reserve the drink owner's seat at the bar, and also prevents the bartender removing the glass. In addition, reports of the surreptitious introduction of date rape drugs into a person's drink creates the need for a simple means of protecting a drink from adulteration or introduction of foreign substances during the owner's absence. Embodiments of the present disclosure meet both needs, as well as serve the customary function of a coaster.

In the present disclosure the term "bar" means a counter in which food or especially alcoholic beverages are served, as well as a table used for the same purpose.

U.S. Pat. No. 5,938,162 discloses a multi-layer coaster.

US 2006/0151413 discloses a security device which allows fluid to be removed from a bottle while preventing the introduction of contaminants.

US 2007/0178284 discloses a date rape drug preventing closure for glasses consisting of a thin film on a carrier. The thin film is removed from the carrier and used to seal the glass.

US 2008/0072412 discloses a thin film mounted on a cutout on a frame which is pressed over the mouth of a glass, sealing the opening and indicating that the drink has not been abandoned.

US 2008/0302794 discloses a security closure for a container which secures a lid using a combination lock.

US 2009/0020546 discloses a tamper resistant closure for containers which prevents introduction of drugs into a drink.

None of the discovered prior art devices provide the advantages of the present disclosure, that of combining the customary functions of a coaster along with means for indicating that a partially consumed drink has not been abandoned and, at the same time, protecting the drink against adulteration.

The foregoing examples of the related art and limitations related therewith are intended to be illustrative and not exclusive. Other limitations of the related art will become apparent to those of skill in the art upon a reading of the specification and a study of the drawings.

BRIEF SUMMARY OF THE INVENTION

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

Embodiments include a combination coaster and cover for a drink glass which comprises a top coaster layer having an upper and a lower surface and an adhesive layer fixedly attached to the lower surface of the coaster layer. A release sheet is removable attached to the adhesive layer. A bottom coaster layer having an upper and a lower surface is fixedly attached to the release sheet at the upper surface of the bottom coaster layer.

In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

DETAILED DESCRIPTION OF THE INVENTION

Figure 1:
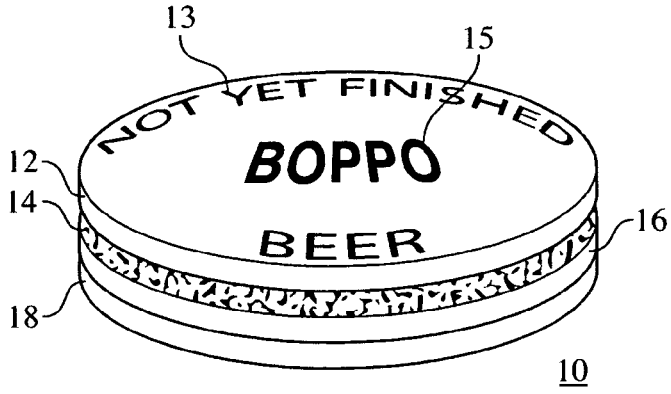
FIG. 1 is a perspective view of an embodiment combination coaster and cover.

FIG. 1 is a perspective view of a first embodiment combination coaster and cover 10. Visible in FIG. 1 is a top coaster layer 12 which may have indicia indicating the intention of a drink owner to return 13 and may also have indicia advertising products 15 on the upper surface. An adhesive layer 14 is fixedly attached to the bottom surface of the top coaster layer. A release sheet 16 is removable attached to the adhesive layer. A bottom coaster layer 18 is fixedly attached to the release sheet 16.

Figure 2:
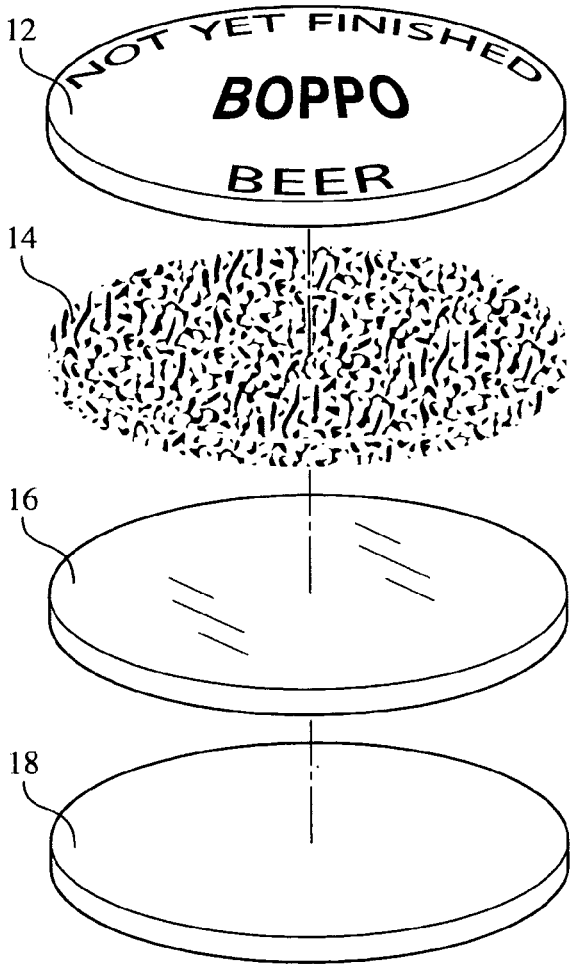
FIG. 2 is an exploded view of the combination coaster and cover of FIG. 1.

FIG. 2 is an exploded view of the first combination coaster and cover of FIG. 1. Embodiments are circular in shape, but embodiments of other shapes, such as rectangles or triangles, are specifically anticipated. Visible in FIG. 2 are the top coaster layer 12, adhesive layer 14 on the lower surface of the upper coaster layer, release layer 16 below the adhesive layer, and the bottom coaster layer. Although FIG. 2 shows the release layer 16 as transparent, in embodiments the release layer is not transparent or is colored.

Figure 3:
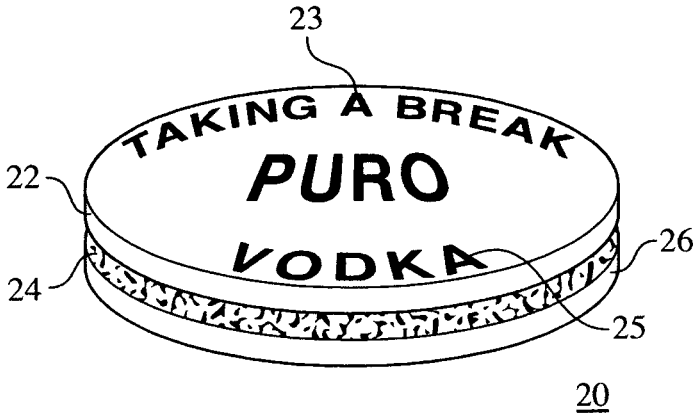
FIG. 3 is a perspective view of a second embodiment combination coaster and cover.

FIG. 3 is a perspective view of a second embodiment combination coaster and cover 20. The second embodiment is similar to the first embodiment except the second embodiment has the release layer combined with the bottom coaster layer. Visible in FIG. 3 is the top coaster layer 22 which may have indicia 23 showing an intention to return or for advertising 25 as customarily is found on coasters. Also visible is the adhesive layer 24 and the release layer 26 which may be combined with a bottom coaster layer. The release layer may serve as a bottom coaster layer. The release layer may be manufactured of any material with the ability to reversibly adhere to the adhesive layer. A suitable coaster can be used as a release layer in embodiments.

Figure 4:
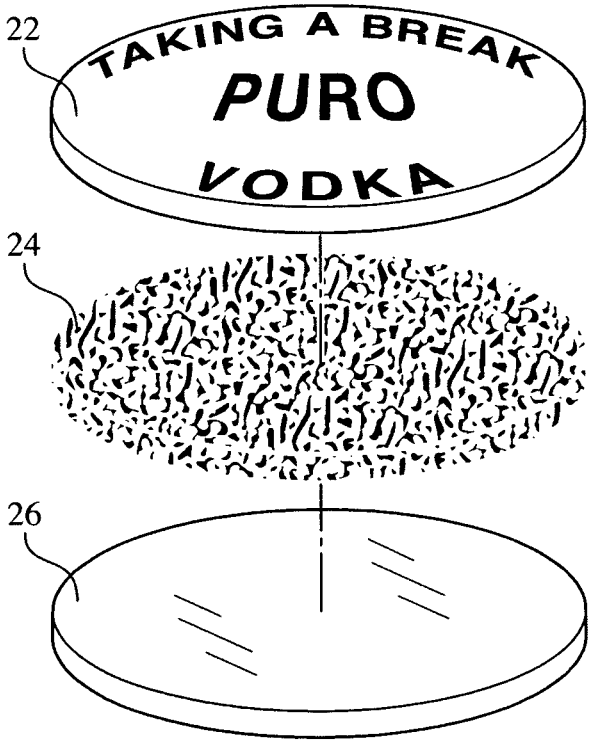
FIG. 4 is an exploded view of the combination coaster and cover of FIG. 3.

FIG. 4 is an exploded view of the combination coaster and cover of FIG. 3. Visible in FIG. 4 is the top or upper coaster layer 22, adhesive layer 24, and release layer 26.

Embodiments fulfill the functions of conventional coasters, that of absorbing moisture which is condensed on the sides and bottom of cool drinks, and that of protecting the bar or horizontal surfaces upon which a drink container is placed. Accordingly, the top and bottom coaster layers of embodiments are manufactured of materials widely used in conventional coasters. In embodiments coaster layers are manufactured of paper, blotting paper, absorbent paper, cork, paperboard, cardboard, plastic, glass, stainless steel, aluminum, copper or soapstone.

In embodiments either or both sides of the coaster layers are colored or printed with indicia such as advertisings, slogans, logos, trademarks, etc. as are conventional coasters. In addition, indicia which enhance the informative function of embodiments may be printed on the coasters. Such indicia make clear that the owner of a drink intends to return and that the drink has not been abandoned.

In embodiments the adhesive layer is comprised of food grade adhesives. One function of the adhesive layer is to attach the top coaster layer to the mouth or opening of a drink container such as a glass or mug, and thereby to indicate the drink has not been abandoned as well as to prevent the adulteration of or introduction of foreign substances into a drink when the owner is temporarily absent. When the drink owner recovers his or her property the top coaster can be removed and discarded or the adhesive layer and release layer can be recombined and the coaster-cover can be reused. The owner then can consume the drink with confidence that it has not been tampered with. In embodiments the adhesive layer is comprised of food grade materials, including silicone, epoxy, polyisobutylene, synthetic rubber or dextrin based adhesive.

In embodiments the release layer is manufactured of plastic film, but any material which adheres to the adhesive layer yet is easily detached from the adhesive layer may be used. It may be necessary to treat the release layer to insure its release from the adhesive layer; for example, a wax layer may allow an otherwise unsuitable material to be useful as a release layer. The suitability of the release layer depends on the nature of the adhesive layer. In embodiments release layers are comprised of suitably treated plastic film, paper, blotting paper, absorbent paper, cork, paperboard, cardboard, plastic, glass, stainless steel, aluminum, or soapstone.

Figure 5:
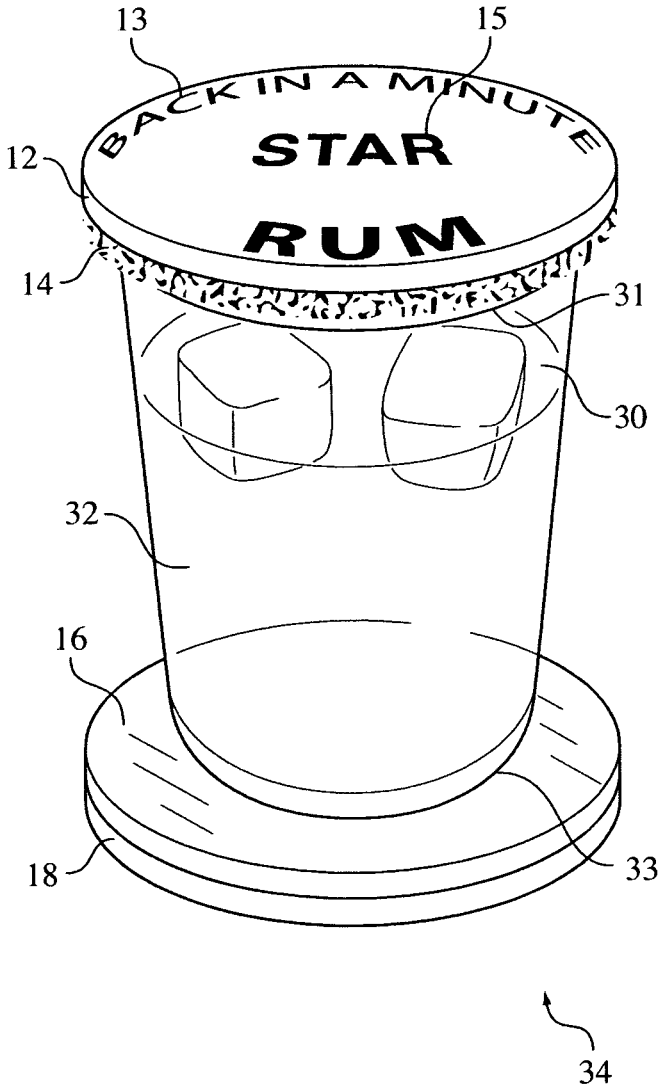
FIG. 5 is a perspective view of a drink with embodiment combination coaster and cover.

FIG. 5 is a perspective view of a drink with embodiment combination coaster and cover. Visible in FIG. 5 is a glass 30 containing a drink 32. The release layer 16 has been detached from the adhesive layer 14. The release layer 16 with attached bottom coaster 18 has been placed between the base 33 of the glass 30 and the bar 34. The top coaster layer 12 rests on the mouth or rim 31 of the glass 30 with the adhesive layer 14 in contact with the rim (indicated by 31 but not visible in FIG. 5) of the glass. The top coaster layer 12 has been sealed to the rim 31 of the glass 30. Optionally, the release layer 16 with attached bottom coaster 18 may be inverted with bottom coaster 18 in contact with the base 33 of the glass 30.

Figure 6:
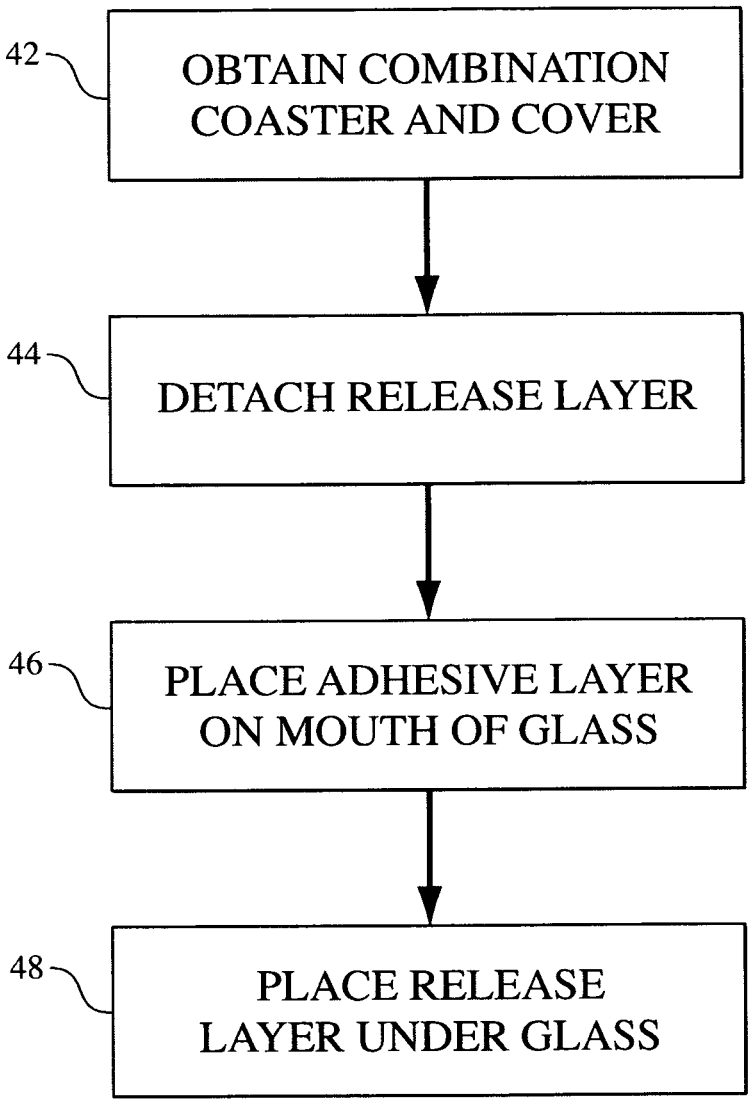
FIG. 6 is a flow chart of the process of indicating a drink glass has not been abandoned and protecting the drink from adulteration.

FIG. 6 is a flow chart of the process of indicating a drink glass has not been abandoned and protecting the drink from adulteration and, optionally, protecting the bar or table using the lower coaster layer. In step 42 the user obtains a combination coaster and cover of the present disclosure. In step 44 the user detaches the release sheet from the adhesive layer. In step 46 the user places the adhesive layer on the mouth or rim of the class containing the drink. This step seals the mouth of the drink and simultaneously indicates to the bartender and others that the user has momentarily stepped out but intends to return and resume possession of the drink. In step 48 the user places the bottom coaster layer with attached release layer under the base or bottom of the drink glass, in order to protect the bar from moisture from the drink glass. The bottom coaster layer or the release layer may be uppermost. Step 48 may be done at anytime after step 44, and may proceed step 46. Step 48 is optional.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. A combination coaster and cover for a drink glass comprising:

a top coaster layer having an upper and a lower surface, an adhesive layer fixedly attached to the lower surface of the coaster layer, a release sheet removable attached to the adhesive layer, a bottom coaster layer having an upper and a lower surface fixedly attached to the release sheet at the upper surface of the bottom coaster, and a drink glass, wherein the release sheet has been removed from the adhesive layer, and the adhesive layer is in contact with the rim of the drink glass, and the release layer is in contact with the base of the drink glass.

2. The combination coaster and cover of claim 1 wherein at least one coaster layer is comprised of paper, blotting paper, absorbent paper, cork, paperboard, cardboard, plastic, glass, stainless steel, aluminum, copper, or soapstone.

3. The combination coaster and cover of claim 1 wherein at least one coaster is comprised of blotting paper.

4. The combination coaster and cover of claim 1 wherein the adhesive layer is comprised of non-toxic food grade adhesive.

5. The combination coaster and cover of claim 1 wherein the adhesive layer is comprised of silicone, epoxy, polyisobutylene, synthetic rubber or dextrin based adhesive.

6. The combination coaster and cover of claim 1 wherein the adhesive layer is comprised of silicone.

7. The combination coaster and cover of claim 1 wherein the release layer is comprised of plastic film, paper, blotting paper, absorbent paper, cork, paperboard, cardboard, plastic, glass, stainless steel, aluminum, or soapstone.

8. The combination coaster and cover of claim 1 wherein the release layer is comprised of plastic film.

9. The combination coaster and cover of claim 1 further comprising indicia on the upper surface of the top coaster layer.

10. The combination coaster and cover of claim 5 wherein the indicia indicates intention of the drink owner to return and reclaim his or her drink.

11. A combination coaster and cover for a drink glass for absorbing moisture from the glass, protecting the surface upon which the drink is sitting, for indicating possession of the drink and protecting the drink from adulteration comprising:

a top absorbent coaster layer having an upper and a lower surface for contacting the bottom of a drink glass on the upper surface of the top absorbent coaster layer, an adhesive layer fixedly attached to lower surface of the top coaster layer for attaching the top coaster layer to the top of the drink glass, thereby covering the drink glass, a release sheet removable attached to the adhesive coating, a bottom absorbent coaster layer having an upper and a lower surface fixedly attached to the release sheet at the upper surface for contacting the top of the bar or table at the lower surface, and a drink container, wherein the release sheet has been removed from the adhesive layer, and the adhesive layer is in contact with the rim of the drink container.

* * * * *